United States Patent [19]

Salmi

[11] Patent Number: 4,971,158

[45] Date of Patent: Nov. 20, 1990

[54] METHOD IN ROTARY DRILLING AND ROTARY DRILLING APPARATUS

[75] Inventor: Pekka Salmi, Tampere, Finland

[73] Assignee: Oy Tampella Ab, Tampere, Finland

[21] Appl. No.: 287,239

[22] Filed: Dec. 21, 1988

[30] Foreign Application Priority Data

Dec. 21, 1987 [FI] Finland ..... 875631

[51] Int. Cl.[5] ..... E21B 7/00; E21B 19/08

[52] U.S. Cl. ..... 173/1; 173/4; 175/27; 175/162; 175/203

[58] Field of Search ..... 173/1, 2, 4, 11, 163, 173/13, 15–18; 408/12; 175/27, 162, 203

[56] References Cited

U.S. PATENT DOCUMENTS

| | | | |
|---|---|---|---|
| 3,233,689 | 2/1966 | Whittle | 173/4 X |
| 3,525,404 | 8/1970 | Newman et al. | 173/128 |
| 3,550,697 | 12/1970 | Hobhouse | 175/26 |
| 3,734,202 | 5/1973 | Gyongyosi | 173/4 |
| 3,917,006 | 11/1975 | Kellner | 175/5 |
| 4,721,172 | 1/1988 | Brett et al. | 175/26 |

FOREIGN PATENT DOCUMENTS

| | | |
|---|---|---|
| 2541795 | 3/1977 | Fed. Rep. of Germany . |
| 201866 | 2/1966 | Sweden . |

*Primary Examiner*—Douglas D. Watts

*Assistant Examiner*—Rinaldi Rada

*Attorney, Agent, or Firm*—Pollock, Vande Sande & Priddy

[57] ABSTRACT

In a rotary drilling apparatus, a rotary head is advanced against an object to be drilled and a neck element included in the rotary head and connected with drilling member is rotated around its longitudinal axis relative to a rotary head body. The neck element is subjected, in a normal drilling situation to the action of two oppositely-directed forces produced by means of a pressure medium, the first force acting in the drilling direction and the second force acting in the direction opposite to the drilling direction, the first force being greater and the difference between the forces producing a feeding force. The neck element is movable in the direction of the feeding force. In a drilling situation, when the force acting in the direction opposite to the feeding force is greater than the feeding force, the neck element moves in the direction opposite to the drilling direction relative to the rotary head body. During this movement, the first force is maintained at least equal to that which is required in a normal situation and the action of the second force is eliminated. As the force exerted on the neck element opposite to the feeding force is diminished, the action of the first and second forces, and thus the feeding force is restored with the neck element moving in the drilling direction.

10 Claims, 4 Drawing Sheets

METHOD IN ROTARY DRILLING AND ROTARY DRILLING APPARATUS

FIELD OF THE INVENTION

The present invention relates to a method in rotary drilling, wherein a rotary head is fed against an object being drilled and wherein a neck element mounted on the rotary head and connected with drilling means is rotated around its longitudinal axis relative to the body of the rotary head.

BACKGROUND ART

Rotary drilling is one type of crushing work in which the actual crushing work is performed by a crushing tool, usually a rotary drill bit, a so-called crown, provided with three cone rollers. The cone rollers are journalled to the body of a rotary drill bit at a pitch of 120°. The cone rollers are fitted with set hard metal studs having a round projecting end. The rotary drill bit is fastened to the end of a drill rod. The opposite end of the drill rod is fastened either to a neck element carried by the rotary head or to a transmitting drill rod with a screw connection. The crushing of rock is effected in rotary drilling by feeding a rotary drill bit perpendicularly against an object, such as a rock, being drilled while rotating it by means of the drill rods using a neck element carried by the rotary head. The rotary head is adapted by means of a feeding mechanism for movement inside a mast connected with a rotary drilling machine. The feeding mechanism comprises either a pinion/rack or a chain/motor transmission. The heavy-duty rotary drilling assemblies are electrically powered. The rotary head is usually provided with two D.C. motors and a necessary gearing whose output shaft is formed by a neck element to which the upper drill rod is screw-threaded.

In the presently used rotary drilling equipment, the neck element is secured axially immovably to the rotary head. Thus, the feeding force is transmitted directly thereby to the thrust bearings of a rotary head.

One of the most serious problems in equipment operating on the rotary drilling principle is irregular vibration caused on the one hand by the structure of a rotary drill bit and on the other hand by the characteristics of an object being drilled. First of all, the outer surface of the cone rollers of the rotary drill bit is provided with hard metal studs which project from the outer surface of cone wheels. The boss of cone rollers is set in reciprocating vertical motion which, in the presently used equipment, forces the drill rods and a rotary head at the end thereof into a corresponding motion. A second and perhaps more significant source of vibration are broken pieces of rock which cannot be immediately flushed away from under the rotary drill bit by flushing medium. The rotary drill bit will be forced to grind such pieces of rock to smaller size. During the crushing operation, these pieces of rock produce an upwardly-directed force on the rotary drill bit.

For the above reasons the presently used rotary drilling mechanisms involve a considerable number of drawbacks, the most important ones being listed hereinbelow:

The service life of a rotary drill bit is short since the bearings of cone rollers are rapidly fatigued and the hard metal studs wear down and fracture due to overload, drilling capacity is not high since the fluctuation of feeding force is considerable (the feeding force needed for breaking rock is at times too low with upward-directed accelerations appearing in the mechanism), substantial vibration which stresses the structures of a rotary drilling machine and a rotary drilling mechanism and causes deterioration in joints and feeding mechanism, the bearings of a rotary head and electric motors are stressed, the vibration tends to shift the entire rotary drilling machine resulting in a hazard of drill pipes bending, breaking and jamming in a bore hole, and the working safety and conditions for the crew of a rotary drilling machine are poor, especially due to vibration.

FIG. 1 a curve indicating the fluctuation of the feeding force of presently used rotary drilling mechanisms relative to time. A straight line $F_S$ parallel to time axis indicates a feeding force required for the breaking effect in a given situation. A curve indicating a momentary feeding force fluctuates on either side of this line. The power peaks crossing above straight line $F_S$ put a particular stress on the bearings of a rotary drill bit with their service life determined by the peaks. The forces going below line $F_S$ are not sufficient for crushing a rock. The rapid fluctuations in feeding force cause vibration.

It is impossible to eliminate the above factors having an effect in rotary drilling and resulting on the one hand from a rotary drill bit and on the other hand from an object being drilled but their detrimental effects, both on rotary drilling operation and on rotary drilling equipment, can be overcome by applying a method of this invention in rotary drilling.

SUMMARY OF THE INVENTION

In order to achieve this objective, a method of the invention is mainly characterized in that the neck element is subjected in a normal drilling situation, through the intermediary of the body of a rotary head, to two oppositely directed forces which are produced by means of a pressure medium and the first of which works in the drilling direction and the second in the direction opposite to the drilling direction, the first force being greater and a difference between the forces providing a the feeding force, the neck element is adapted to be movable in the acting direction of a feeding force whereby, if in a drilling situation the force directed at the neck element and opposite to the feeding force is greater than the feeding force, the neck element moves in a direction opposite to the drilling direction relative to the body of a rotary head, and during the movement the power of said first force is maintained at least equal to a normal situation and the action of the second force is eliminated and, as the action of a force directed at the neck element and opposite to feeding force diminishes, the action of the first and second forces, and thus the feeding force produced by the difference therebetween, is restored as the neck element is moving in drilling direction.

The above solution is capable of eliminating the vibrations directed to the rotary head of a rotary drilling apparatus, it is capable of adjusting a feeding force to properly match each object and furthermore the feeding force can be maintained at a correct level. The fluctuation of a feeding force is minimized since the mass of the apparatus is not subjected to upwardly-directed accelerations. The rotary drill bit is always under the action of a force equal to or greater than what is required for the breaking work, so the breaking work is timewise more effective than with the presently used equipment. The bearing loads on the cone rollers of a rotary drill bit are more uniformly distributed and the duration of the bearings is improved. This means that, with the same calculated bearing service life as that obtained in traditional solutions, the feeding force can be increased and thus an improved drilling capacity achieved. This is definitely advantageous particularly in hard species of rock since the breaking work requires more power. On the other hand, the increase of drilling capacity naturally depends on whether the discharge of crushed rock effected by a flushing medium can be increased without restrictions.

The invention present relates also to a rotary drilling apparatus which is intended to be installed in connection with a rotary drilling machine.

The rotary drilling apparatus is capable of providing the advantages previously described in connection with the method.

The invention will now be described in more detail in the following specification with reference made to an embodiment illustrated in the accompanying drawings. In the drawings

DETAILED DESCRIPTION OF THE PREFERRED EMBODIMENT(S)

Figure 1:
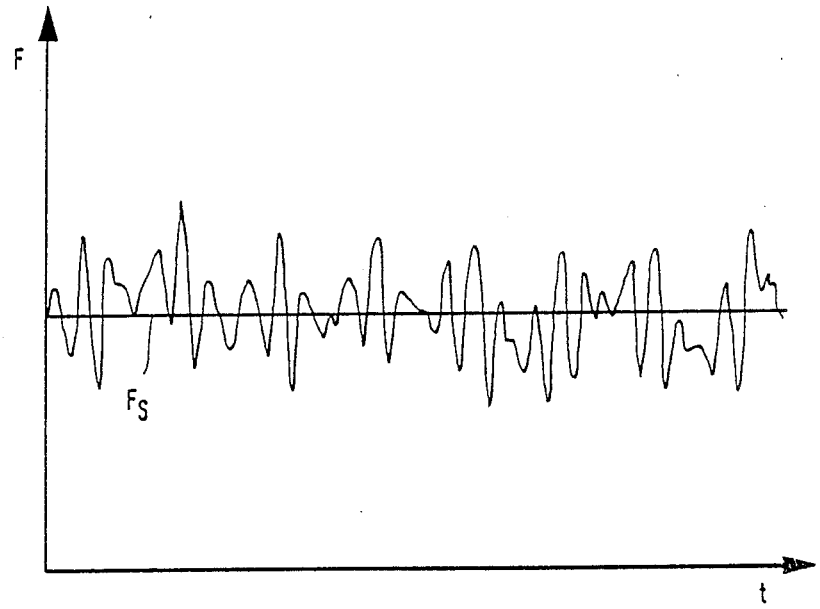
Fig. 1 PRIOR ART
Figure 2:
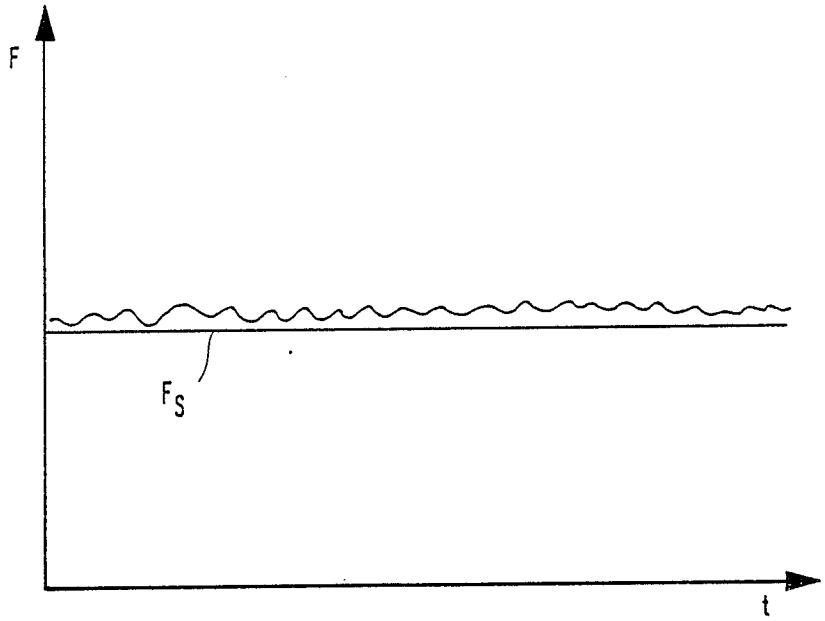
FIG. 2 shows the fluctuation of a feeding force in a method and rotary drilling apparatus of the invention relative to time.

The fluctuation curve for a feeding force shown in FIG. 2 is obtained with a principle shown in FIG. 3. FIG. 3 illustrates diagrammatically the operating principle of the method. Thus, the body 1 of a rotary head is provided with a cylinder space 2 in which is fitted a piston 3*a* carried by a neck element 3. Piston 3*a* divides cylinder space 2 into two pressure chambers. A first pressure chamber 4 is connected via a supply duct 5 to a source of pressure medium. In addition, the first pressure chamber 4 is connected via a duct 6 to a pressure accumulator 7 or the like. The pressure of a pressure medium prevailing in the first pressure chamber applies with a force $F_1$ upon a first bearing surface 8 on piston 3*a* of the neck element 3. This produces a first force $F_1$ acting in drilling direction (arrow P). A second pressure chamber 9 is connected via a supply duct 10 to a source of pressure medium and the pressure prevailing in this pressure chamber is applied to a second bearing surface 11 on piston 3*a* of neck element 3. This produces a second force $F_2$ acting in the direction opposite to drilling direction (arrow P) . The rotary head body 1 is further provided with an annular discharge space 12 in communication with a corresponding outlet duct 13.

In a drilling situation, as the rotary head is fed in a drilling direction and force $F_1$ is selected so as to exceed force $F_2$, the effective feeding force $F_S$ will be the difference between forces $F_1$ and $F_2$ in a normal drilling situation. Thus, neck element 3 finds its way to a balanced position shown in FIG. 3*a*. Thus, the feeding force will be greater than or equal to a force $F_M$ required for a crushing operation.

When the force $F_M$ required for crushing increases for some above-described reason, the neck element will move in the direction opposite to the drilling direction in cylinder space 2. Thus, during the motion of a neck element, some pressure medium passes from pressure chamber 4 into pressure accumulator 7 and at the same time a communication opens from second pressure chamber 9 to discharge space 12. This eliminates the action of second force $F_2$ and the power of feeding force $F_S$ is equal to the force created by the pressure prevailing in first pressure chamber 4. Hence, the effective feeding force $F_S$ increases. This addition to the force in the drilling direction applied to the neck element means that the neck element now tends to move more vigorously in the drilling direction (arrow P) and thus to return the condition from a position shown in FIG. 3*b* back to a balanced condition according to the normal drilling situation shown in FIG. 3*a*. This arrangement provides the feeding force fluctuation curve shown in FIG. 2 which at each moment of time is at least equal to the required minimum feeding force $F_S$ shown in FIG. 2 by a straight line. On the other hand, there are no peak-shaped overload peaks.

Figure 4:
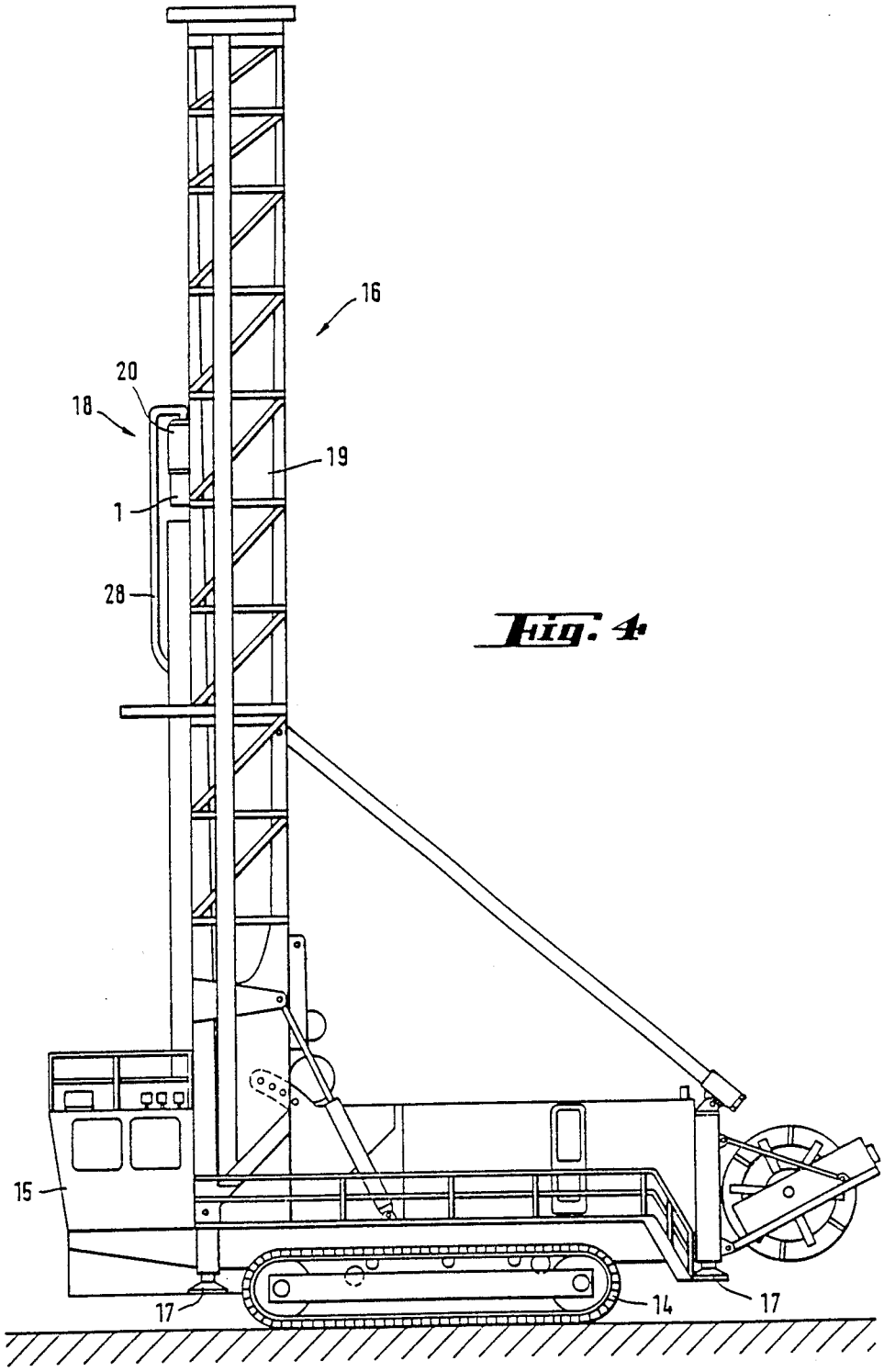
FIGS. 4 and 5 are general views of a rotary drill working machine in side and frontal views.
Figure 5:
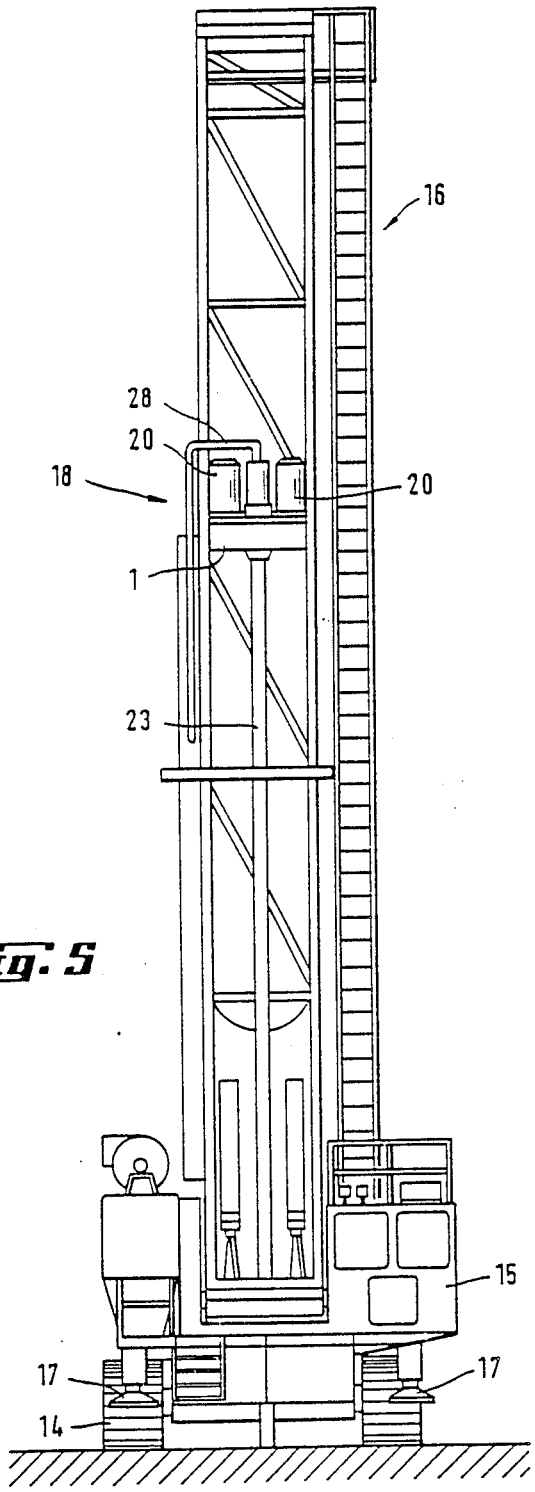

A method and rotary drilling apparatus of the invention are employed in the connection with a rotary drill working machine shown in FIGS. 4 and 5. A rotary drill working machine shown in FIGS. 4 and 5 is adapted to travel on caterpillar tracks 14 and it includes a cabin 15 and a mast 16 that can be tilted in a vertical plane. The working machine includes supporting legs 17 for supporting it on the ground during rotary drilling. A rotary drilling apparatus 18 is movable upon guides in the longitudinal direction of a mast by means of a driving mechanism (not shown). The mast 16 includes also a drill rod storage 19.

Figure 6:
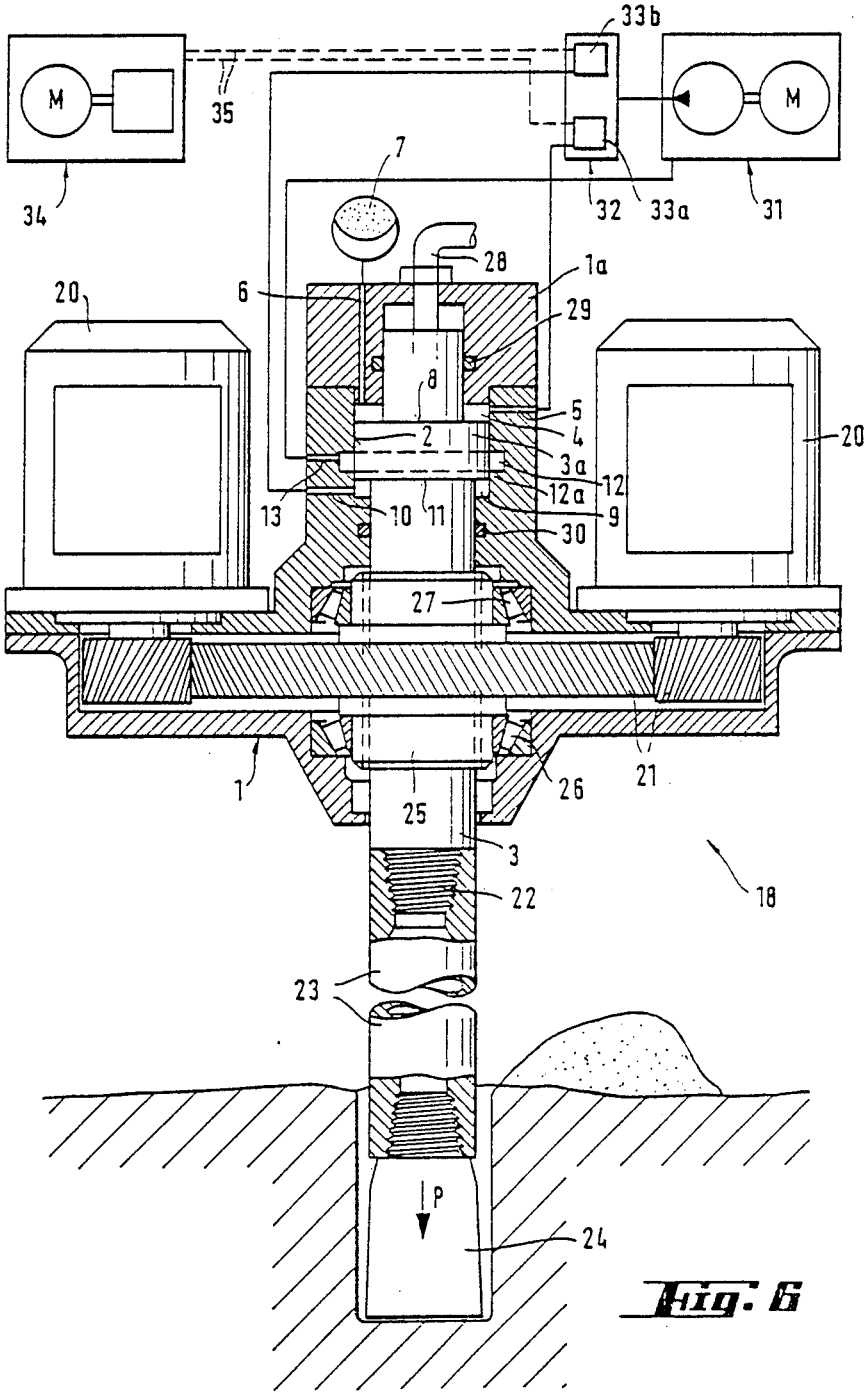
FIG. 6 shows a cross-section of the body of a rotary head.

FIG. 6 shows in a partial section a rotary drilling apparatus 18 and referentially a driving mechanism. The figure does not illustrate the attachment of a mast to a rotary drilling apparatus or the detailed design of a driving mechanism. FIG. 6 includes the same reference numerals as FIGS. 3*a* and 3*b* to indicate the corresponding components.

The rotary head includes a body 1, two motors 20, a gearshift 21 and a neck element 3. The neck element 3 includes a lower threaded portion 22 for fastening an upper drill rod 23. The end of a lower drill rod carries a rotary drill bit 24 serving as a crushing tool. At gearshift 21 there is a clutch 25 transmiting the rotating motion of a neck element and journaled with bearings 26 and 27 to the body 1 of the rotary head. The construction of such a clutch 25, which facilitates the axial movement of a neck element relative to rotary head body 1 but still facilitates the transmission of a rotary force, is obvious to a skilled person so it is not explained in more detail in this context. The rotary head body further includes a shaped piece 1*a*, inside which is fitted the rear portion of neck element 3 and especially a piston 3*a* carried thereby. Through tubular neck element 3 (the hole is not shown) is passed scavenging air by way of a pipe connection 28 mounted on the rear portion of a neck element. The scavenging air passes through the neck element by way of drill rods 23 to a rotary bore hole 24. On either side of cylinder space 2 there are sealings 29 and 30. The rotary drilling apparatus includes a pressure medium unit 31, comprising a motor and a hydraulic pump. This unit is connected by way of a set of valves 32 with first 4 and second 9 pressure chamber. A set of valves 32 consists of two pressure control valves 33*a* and 33*b* which are controlled by means of control signals coming from a rotary head driving mechanism 34 (dash lines 35).

Figure 3B:
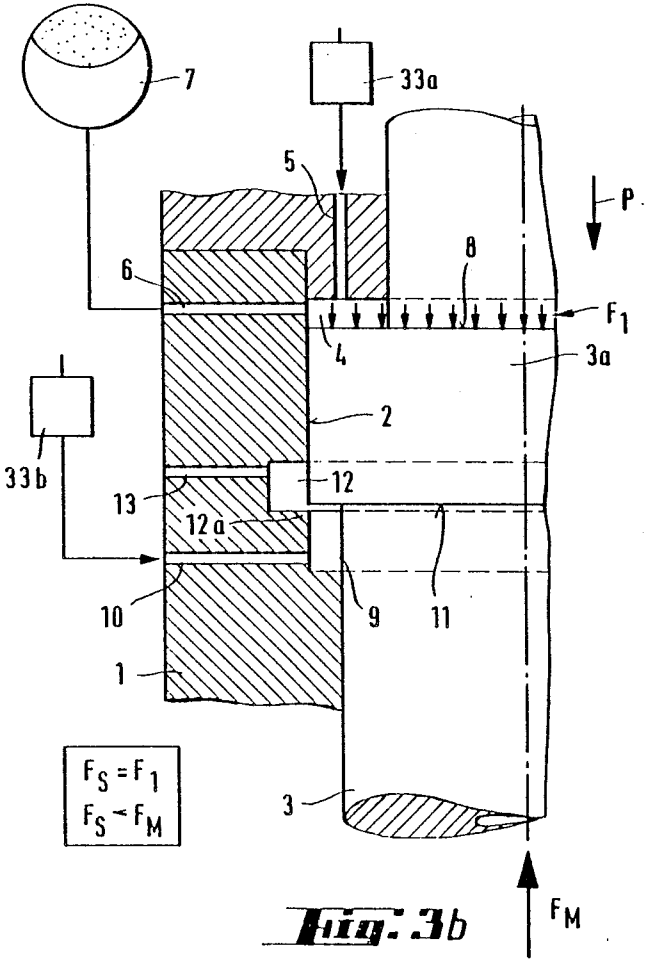
FIGS. 3*a* and 3*b* shows diagrammatically the operating principle of the method.
Figure 3A:
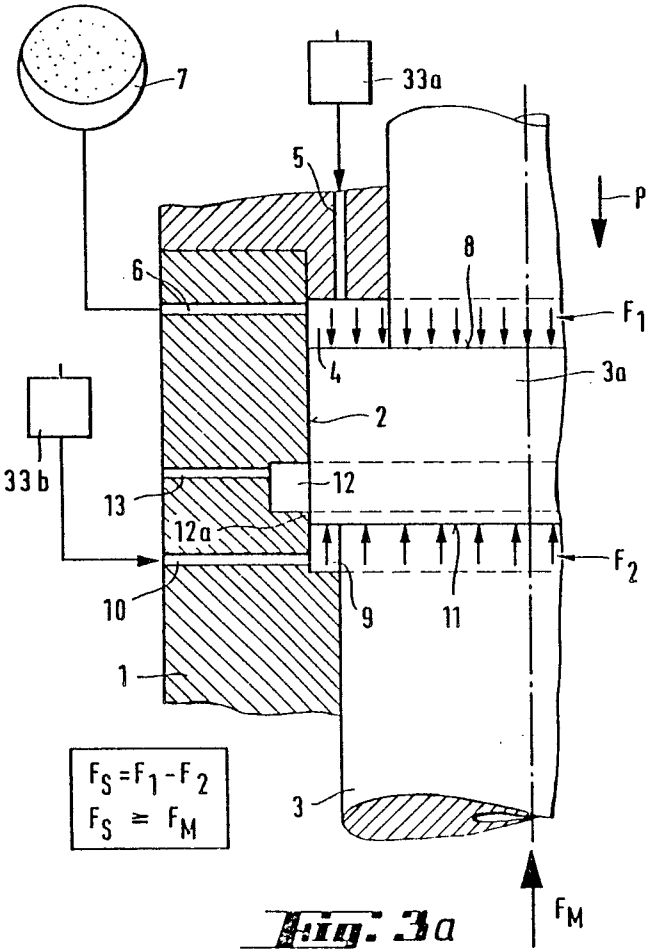

A rotary drilling apparatus of the invention operates such that in a drilling situation, the driving mechanism 34 feeds rotary drilling apparatus 18, drill rods 23 and bit 24 toward an object, such as a rock, to be drilled along guides carried by the mast. Through the intermediary of gearshift 21 motors 20 set neck element 3, drill rods and crushing tool in rotating motion. The rock fractures when the effective feeding force $F_S$ reaches a limit force required for fracturing, the neck element 3 being supported on the pressure force prevailing in first pressure chamber 4. A pressure force $F_1$ prevailing in the first pressure chamber is adjusted by means of valve 33*a* to a precalculated value as controlled by the feeding force. Into the second pressure chamber 9 is supplied pressure from valve 33*b* only so much that a second bearing surface 11 on piston 3*a* of neck element 3 finds its way to a position adjacent to an edge 12*a* of the discharge space for adjusting a throttle gap (FIGS. 3*a* and 3*b*). An intentional attempt is made to minimize force $F_2$ as it causes variations in the balance of forces which tend to increase the fluctuation of feeding force. As a force $F_M$ applied from rotary drill bit 24 to the neck element and directed opposite to drilling direction urges drill rod 23 upwards, the neck element moves up squeezing a pressure medium contained in first pressure chamber 4 into pressure accumulator 7, whereby the gas contained in the pressure accumulator is compressed. It is preferable that the gas volume of pressure accumulator 7 be proportioned to the surface area of the first bearing surface 8 of neck element 3 in a manner that the resilience constant of pressure accumulator 7 is flat within the main feeding force range of a rotary drilling apparatus. Thus, pressure increase caused by the movement of neck element 3 in first pressure chamber 4 is slight. The movement of neck element 3 in the direction opposite to the drilling direction does not result in exceeding a force caused by the entire mass of a rotary drill working machine and serving as a counterforce for the feeding force. Thus, the mass of a rotary drill working machine is not subjected to a movement upwards. This would naturally result in the reduction of feeding force and in vibration. When neck element 3 has pushed itself in the direction opposite to the drilling direction, the pressure in second pressure chamber 9 has dropped since communication has opened between said second pressure chamber 9 and discharge space 12 (pressure medium unit 31). Thus, a force $F_S$ acting in the drilling direction is equal to a force $F_1$ prevailing in first pressure chamber 4. This force exceeds the effective feeding force $F_S$. Thus, the neck element 3 tends to move back to the balanced position. Hence, the increase of a pressure prevailing in second pressure chamber 9 balances the situation. The second pressure chamber and a pressure prevailing therein decreases the traveling speed of neck element 3 in the drilling direction relative to the rotary head body, whereby the neck element is not set in reciprocating motion.

After completing a hole being drilled, drill rods 23 and rotary drill bit 24 are withdrawn up. During the return feed, a high pressure must be supplied into second pressure chamber 9 in order to prevent piston 3*a* of neck element 3 from depressing to the bottom of the second pressure chamber. The pressure control is coupled in a feeding unit to control valve 33*b* and the pressure of first pressure chamber 4 is nearly zero during the return feed.

In each drilling situation, the driving mechanism 34 controls valves 33*a* and 33*b*, whereby the difference between forces $F_1$ and $F_2$ and the prevailing pressure level can be adjusted to suit a given object being drilled.

It is obvious that constructively the invention can be realized in a plurality of ways. Thus, a cylinder space 2 can be disposed also below a gearshift 21 or even so that the first pressure chamber lies above the gearshift and the second below the gearshift.

I claim:

1. A method for rotary drilling, with a drilling apparatus including a rotary head which is fed against an object being drilled, a neck element movably mounted on said rotary head and connected with a drilling rod member, and a head body member provided in said rotary head, said head body member including a space formed therein, said neck being rotated around its longitudinal axis relative to said head body member, said method comprising the steps of:

providing said neck element with a piston for dividing said space into two pressure chambers;

subjecting said neck element, while drilling at a selected normal drilling condition, to two oppositely-directed forces which are produced by means of a pressure medium, the first force working in a drilling direction in a first pressure chamber and the second force working in the direction opposite to the drilling direction in a second pressure chamber, the first force being greater than the second force and a difference between the first and second forces providing a feeding force;

effecting movement of said neck element relative to said rotary head body member in the direction of action of said feeding force during said selected normal drilling condition and in the direction opposite to the drilling direction in a drilling condition in which a crushing force applied to said neck element and opposite to said feeding force increases to become greater than said feeding force;

maintaining the first force during said movement of said neck in the direction opposite to the drilling direction as being at least equal to that which is required in said selected normal drilling condition by releasing part of the pressure medium to a pressure accumulator which is connected to said first chamber; and releasing part of the pressure medium by opening a connection between said second chamber and a discharge space upon said movement of said neck element to eliminate said second force, and wherein upon diminishing of the action of said crushing force applied to the neck element and opposite to said drilling direction, said first and second forces, and thus the feeding force produced by the difference therebetween are being restored as the neck element is moving in the drilling direction.

2. A method according to claim 1, wherein said first force is maintained substantially constant in a selected drilling condition.

3. A method as set forth in claim 1, wherein said first and second force and thereby said feeding force are adjustable to comply with the requirements of an object to be drilled.

4. A method as set forth in claim 3, wherein the values of said first and second forces are adjustable by means of separate pressure control valves which are controlled by signals from a rotary head driving mechanism.

5. A rotary drilling apparatus, comprising:

a rotary head including a body member, a neck element and means for rotating the neck element relative to said body member of the rotary head and being in communication with means for feeding the rotary head against an object to be drilled;

said neck element being movable in the direction of its longitudinal axis relative to said rotary head body member, said neck element including a piston;

said rotary head body member being provided with a cylinder space for receiving said piston of said neck element therein;

said piston dividing said cylinder space into a first and a second pressure chamber;

said first and second pressure chambers having means coupled therewith for adjusting the pressure of a pressure medium contained in said first and second pressure chambers;

said first pressure chamber being connected to a pressure accumulator for releasing part of said pressure medium from said first chamber upon upward movement of said piston; and said rotary head body member being provided with a discharge space which is adapted to be in communication with said second pressure chamber upon said movement of said piston.

6. A rotary drilling apparatus according to claim 5, wherein a clutch is provided which is journalled to the rotary head body between the neck element and a gearshift for causing movement of said neck element in the direction of its longitudinal axis.

7. A rotary drilling apparatus according to claim 6, wherein the gas volume of said pressure accumulator is proportional to the volume of said first pressure chamber, such that the elastic constant of said pressure accumulator is flat within the main operating range of the feeding force of the rotary drilling apparatus.

8. A rotary drilling apparatus according to claim 5, wherein said means for adjusting the pressure of a pressure medium in said first and second pressure chambers comprises pressure control valves which are mounted in connection with a pressure medium unit included in the rotary drilling apparatus and which are controlled by control signals from a driving mechanism connected with the rotary drilling apparatus.

9. A rotary drilling apparatus according to claim 5, wherein the gas volume of said pressure accumulator is proportional to the volume of said first pressure chamber, such that the elastic constant of said pressure accumulator is flat within the main operating range of the feeding force of the rotary drilling apparatus.

10. A rotary drilling apparatus according to claim 5, wherein said discharge space is provided at the piston of said neck element in said rotary head body as an annular space surrounding said piston and in communication with said first pressure chamber through an outlet duct included in said head body member.

* * * * *